United States Patent [19]

Crowell

[11] 4,178,832

[45] Dec. 18, 1979

[54] AUTOMATIC GUN HAVING GAS LEAKAGE CONTROL MECHANISM

[75] Inventor: Robert B. Crowell, Newport Beach, Calif.

[73] Assignee: The United States of America as represented by the Secretary of the Army, Washington, D.C.

[21] Appl. No.: 909,741

[22] Filed: May 25, 1978

[51] Int. Cl.[2] ..... F41D 1/06

[52] U.S. Cl. ..... 89/159; 89/193

[58] Field of Search ..... 89/159, 163

[56] References Cited

U.S. PATENT DOCUMENTS 3,713,363 1/1973 Hurlemann ..... 89/159

*Primary Examiner*—Stephen C. Bentley

*Attorney, Agent, or Firm*—Peter A. Taucher; John E. McRae; Nathan Edelberg

[57] ABSTRACT

This invention relates to automatic guns having bolt carriers operated by recoil movement of the gun barrel. High pressure gas is bled from the barrel into a gas tube that delivers both mechanical and fluid pressure forces to a piston impactor aligned with the bolt carrier. Special floating rings are arranged on the gas tube to provide controlled escape of high pressure gas from the tube. The floating rings are shiftable radially to compensate for manufacturing tolerance build-ups in the gun components. The invention reduces manufacturing costs and also increases field service capabilities.

3 Claims, 5 Drawing Figures

AUTOMATIC GUN HAVING GAS LEAKAGE CONTROL MECHANISM

The invention described herein may be manufactured, used, and licensed by or for the Government for governmental purposes without payment to me of any royalty thereon.

BACKGROUND AND SUMMARY OF THE INVENTION

U.S. Pat. No. 3,512,449 shows an automatic gun wherein recoil movement of the barrel causes an impactor piston to drive a bolt carrier rearwardly at an accelerated rate (greater than the barrel recoil speed). As the bolt carrier moves rearwardly the gun bolt is rotated to the unlocked position; the bolt moves rearwardly away from the barrel to enable an extracting claw on the bolt to withdraw the spent cartridge casing from the firing chamber. As the bolt carrier reaches its rearmost position an ejecting pin slides forwardly to eject the spent cartridge casing from the bolt. During the counter recoil period a compressed coil spring propels the bolt carrier forwardly; a cam mechanism associated with the bolt carrier feeds a new round of ammunition into the space vacated by the spent cartridge casing.

Automatic guns of the above type require a rapid but controlled motion of the bolt carrier in order that all of the required motions occur within the available time interval (less than 0.2 seconds in some cases). To give the bolt carrier a quick starting action in the rearward direction it has been proposed to utilize the combustion gases in the barrel as an operating force; see for example U.S. Pat. No. 2,393,627 to J. C. Garand. Such combustion gases are generated prior to the start of the barrel recoil movement; by diverting some of the hot combustion gases against the impactor piston it is possible to achieve a very high operating force during the barrel recoil movement.

In one existing arrangement the gun barrel delivers a mechanical operating force to the impactor piston via a hollow tubular gas tube that extends into the cylinder that guides the impactor piston. As the gun is fired some of the hot combustion gas is diverted from the barrel into the tubular gas tube, where it is momentarily trapped. During the recoil period the gas tube delivers a mechanical force to the impactor piston; additionally the hot gases are fully released through the tube to produce an added force on the piston.

Proper flow of combustion gases through the tube requires a minimum escape of gas across the clearance space between the tube outer surface and the cylinder inner surface. Providing this minimum escape or leakage has been a problem. A related difficulty is potential binding of the gas tube on the cylinder wall. If the tube is made to have too tight a fit in the cylinder there may be binding, with possible malfunction and/or degradation of service life. If the tube has an extremely loose fit in the cylinder the leakage flow may be too great for satisfactory impact force.

The gas tube is carried by a yoke that depends from the barrel, whereas the cylinder is mounted on the underside of the receiver. Manufacturing tolerances and slide clearances are such that it was very difficult to provide the desired fit of the gas tube in the cylinder. In some instances it was necessary to delay final machining until after the gun components had been partially assembled together. The guns produced by this procedure were costly and difficult to service because the parts were custom fit components that were not functionally interchangeable with other spare parts having the same nominal dimensions.

The present invention relates to a floating seal assembly that can be installed in the cylinder to provide a desired fit on the gas tube without producing the binding action that has sometimes occurred using standard sealing procedures. The floating seal assembly of the invention is able to move radially under the impetus of the gas tube, so that the tube can slide freely back and forth without binding on the cylinder wall. Radial movements of the seal assembly avoid the necessity for match drilling the cylinder to custom fit peculiar gas tubes or tube eccentricities. The invention reduces manufacturing costs and also increases field service capabilities.

THE DRAWINGS

FIG. 1 fragmentarily illustrates a prior art recoil-operated mechanism for operating an impactor piston.

Figure 1:
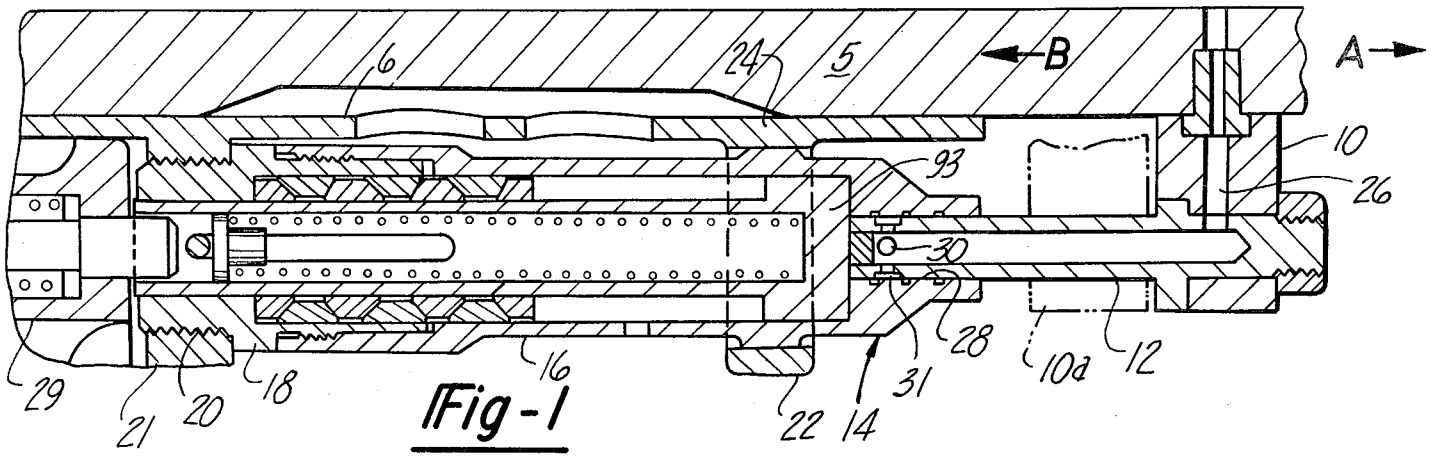
Fig-1 PRIOR ART

FIG. 1 fragmentarily illustrates an automatic gun of the type more completely shown and described in U.S. Pat. No. 3,512,449. Mechanical parts not shown in FIG. 1 (such as the firing chamber, bolt, cartridge extraction mechanism, and round feeding means) would in practice be as shown in the referenced patent. FIG. 1 fragmentarily shows the gun barrel 5 slidably mounted for movement in receiver 6. As the projectile is discharged from the barrel in a rightward direction (letter A) the barrel recoils in a leftward direction (letter B). The barrel carries a depending yoke 10 that mounts a gas tube 12. Tube 12 extends rearwardly from the yoke into a cylinder 14 that comprises two threadedly-connected components 16 and 18. Component 18 includes a stud portion 20 that threads into an opening in wall 21 of the receiver. Component 16 is cradled within a yoke 22 that depends from the underside of receiver wall 24.

During recoil movement of gun barrel 5 yoke 10 moves to the dotted line positin 10*a*. The rear end of tube 12 therefore delivers a mechanical blow to the front face of an impactor piston 93 that is slidably disposed within cylinder 14. Piston 93 is accelerated rearwardly to apply an operating force on the bolt carrier 29. The bolt carrier may be constructed as shown in U.S. Pat. No. 3,512,449.

At the instant when a round of ammunition is fired a small amount of hot combustion gas is fed from barrel 5 through yoke passage 26 into gas tube 12, where it is momentarily trapped. During recoil the high gas pressure within tube 12 is applied to the front face of impactor piston 93, to augment the mechanical force developed by the barrel recoil movement. Gas flows from tube 12 into the right end of cylinder 14 via a passage system that includes four radial holes 30 and an annular groove 31 in the end area of tube 12. Gas flow into cylinder 14 is delayed until tube 12 has moved a sufficient distance into the cylinder so that groove 31 is exposed to the cylinder space to the right of piston 93. A relatively small clearance space of about 0.001 inch (radial dimension) is required between the outer surface of tube 12 and the tube guide surface 28.

The required tolerances on the annular clearance at surface 28 must be fairly close if gas leakage is to be minimized without binding of the gas tube on wall surface 28. Unfortunately the design of the gun is such that it is difficult to maintain the desired tolerances. The major problem is to maintain concentricity between tube 12 and cylinder 14; this is difficult because the tube and cylinder are mounted on different components. Thus tube 12 is mounted on yoke 10, which is in turn mounted on barrel 5; cylinder 14 is mounted in receiver 6 (at stud 20 and yoke 22). Tolerance build-ups work against exact alignment of tube 12 and cylinder 14. These tolerance problems contribute to non-concentricity and also non-parallelism movement effects. Thus, tube 12 may not be quite parallel to barrel 5, in which case the tube will move at a slight angle to the barrel during the recoil stroke. Similarly, cylinder 14 may be at a slight angle to receiver 6. Therefore, it is possible for tube 12 to bind against cylinder surface 28 even though the tube and cylinder are concentric in the as-manufactured state.

Figure 2:
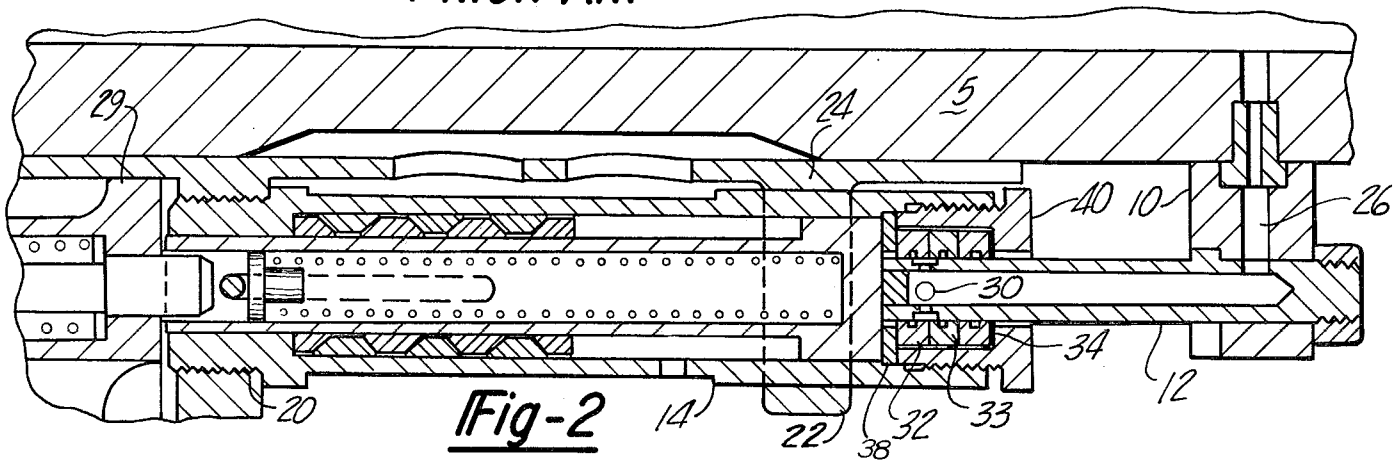
FIG. 2 is a view illustrating a mechanism of the present invention designed to replace the FIG. 1 mechanism.
Figure 3:
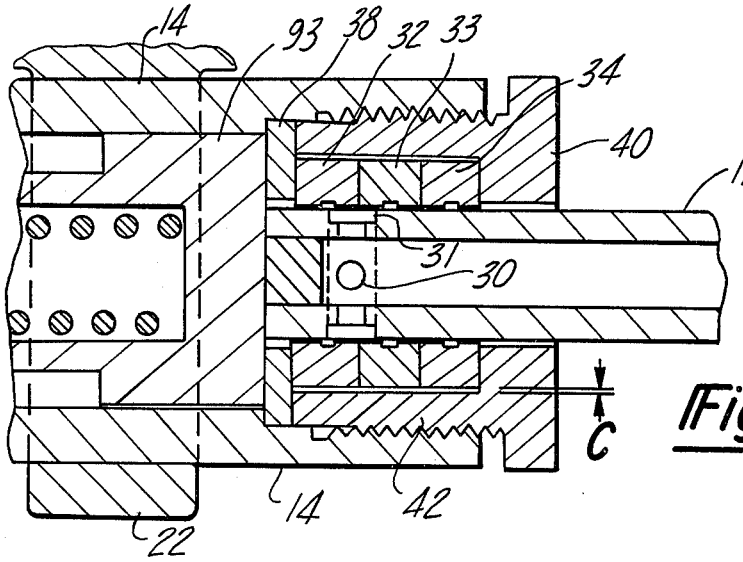
FIG. 3 illustrates in greater detail the novel feature of the FIG. 2 mechanism.

The present invention is directed to a floating ring seal system designed to alleviate the leakage control problem and binding problem associated with the FIG. 1 arrangement. One embodiment of the invention is shown in FIGS. 2 and 3. As seen in FIGS. 2 and 3, there are three similar leakage control rings 32, 33 and 34 stacked within a confining cage defined by washer 38 and plug 40. The inner diameter of each leakage control ring is about 0.002 inch greater than the outer diameter of tube 12; therefore the annular leakage path between the ring and tube surface is precisely controlled at about 0.001 inch. Tolerance problems are avoided by floatably mounting the leakage control rings so that each ring can individually move radially within the confining cage structure. Such radial motion is made possible by making the outer diameter of each ring 32, 33 or 34 less than the inner diameter of the annular plug wall 42. The radial clearance C between the leakage rings and cage wall 42 is not especially critical, the requirement being to compensate in a qualitative fashion for manufacturing or assembly misalignments between cylinder 14 and tube 12.

It would be possible to substitute one relatively thick leakage control ring for the three thinner rings shown in the drawing. However a single thicker ring would have an undesirably high length-to-diameter ratio that could conceivably produce tube binding in the event that tube 12 moves at an angle to the axis of cylinder 14. The individual rings 32, 33 and 34 are radially shiftable independently of one another for compensation against the potential binding action caused by non-parallel movement of tube 12 (relative to the axis of cylinder 14). The cage side wall 42 has a length that corresponds to the total thickness of the three rings 32, 33 and 34, plus a very slight axial clearance for permitting radial motion of each ring when plug 40 is screwed tight against washer 38.

Figure 4:
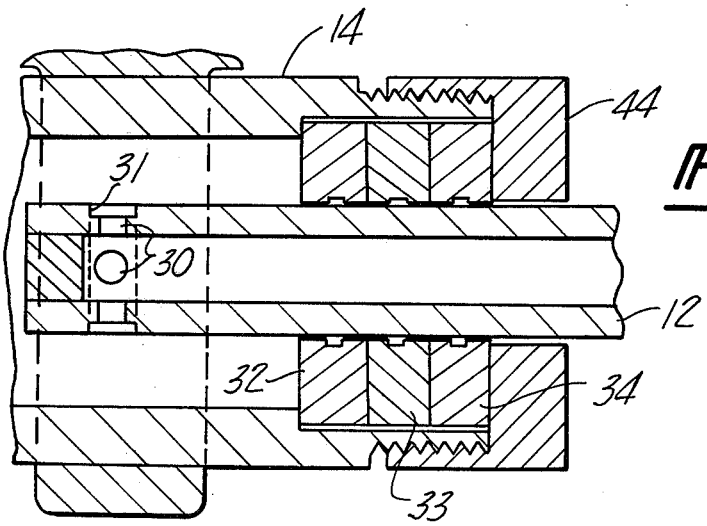
FIG. 4 shows a variant of the FIG. 3 mechanism, taken with the gas tube in a different position of adjustment, namely at the end of the recoil stroke.

It is not necessary that the ring-confining cage structure be constructed exactly as shown in FIG. 3. FIG. 4 illustrates a variant wherein the cage is formed by a counterbore in cylinder 14 and a plug 44 threaded onto the outer surface of the cylinder. The length of the counterbore determines the effective axial length of the cage.

Figure 5:
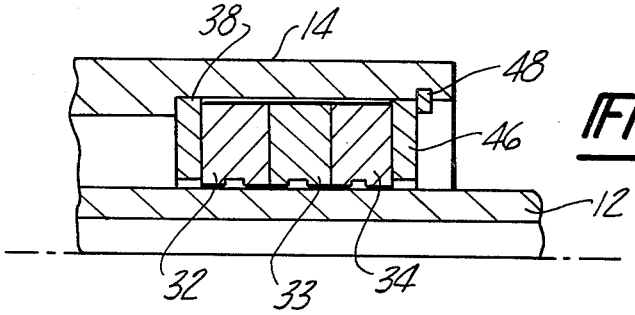
FIG. 5 illustrates a further variant of the FIG. 3 mechanism.

FIG. 5 fragmentarily illustrates another embodiment of the invention, wherein the cage is defined by two axially spaced washers 38 and 46. A conventional E-ring 48 is snapped into a groove in the wall of cylinder 14 to retain the otherwise loose components in operative position.

I wish it to be understood that I do not desire to be limited to the exact details of construction shown and described for obvious modifications will occur to a person skilled in the art.

I claim:

1. In a recoil-operated automatic gun comprising a receiver, a barrel mounted for reciprocal axial movement in the forward portion of the receiver, a bolt carrier slidably disposed within the receiver, and means for operating the bolt carrier; said bolt-operating means comprising a gas cylinder projectly forwardly from the receiver, a piston slidably disposed within the cylinder, a yoke depending from the barrel forwardly of the receiver and a gas tube extending rearwardly from the yoke into the gas cylinder; said piston having its forward end normally engaged with the gas tube and its rearward end engaged with the bolt carrier, whereby the action of firing a round causes hot combustion gases to be introduced from the barrel into the gas tube through the afore-mentioned yoke, after which the barrel recoils to produce both mechanical and gas pressure forces on the forward end of the piston:

the improvement comprising a series of leakage control rings floatably positioned within the gas cylinder in surrounding relationship to the gas tube, each control ring having an internal diameter that is only slightly larger than the external diameter of the tube by a specified amount; each leakage control ring being capable of independent adjustment in any radial direction whereby the individual rings are precluded from binding frictional contact with the tube even though the tube and barrel may not move precisely parallel to one another.

2. The improvement of claim 1: each leakage control ring having flat parallel radial faces whereby the individual rings can slide radially on one another under the impetus of the gas tube; and means carried by the cylinder for confining the leakage control rings against axial movement.

3. The improvement of claim 2: wherein the ring-confining means comprises a flat-surfaced washer (38) positioned within the gas cylinder in surrounding relation to the tip area of the gas tube, and a plug (40) threaded into the end of the cylinder so that an end thereof abuts against one face of the wahser; said washer and plug defining a ring-confining cage of predetermined axial dimension corresponding to the total axial thickness of the leakage control rings.

* * * * *